United States Patent [19]

Dickerson et al.

[11] 4,293,632

[45] Oct. 6, 1981

[54] ATTRITION PROCESS FOR ALTERATION OF TONER PARTICLES CONTAINING CONDUCTIVE MATERIALS

[75] Inventors: Charles G. Dickerson, Farmington; Peter F. Erhardt, Webster, both of N.Y.

[73] Assignee: Xerox Corporation, Stamford, Conn.

[21] Appl. No.: 892,717

[22] Filed: Apr. 3, 1978

[51] Int. Cl.[3] ..... G03G 9/08

[52] U.S. Cl. ..... 430/137; 241/5; 241/14; 241/18; 241/19; 264/140; 430/109; 430/903; 430/111

[58] Field of Search ..... 252/62.1 P; 241/14, 241/18, 5, 19; 430/137, 109, 903, 111; 264/140

[56] References Cited

U.S. PATENT DOCUMENTS

| | | | |
|---|---|---|---|
| 3,595,486 | 7/1971 | Stephanoff | 241/5 |
| 3,639,245 | 2/1972 | Nelson | 430/110 X |
| 3,909,258 | 9/1975 | Kotz | 430/110 X |

*Primary Examiner*—John D. Welsh
*Attorney, Agent, or Firm*—E. O. Palazzo

[57] ABSTRACT

Described is a process for the treatment of certain toner materials, useful in electrophotographic development, which process in one embodiment involves subjecting an electrically conductive toner material to an attrition process, thus causing the removal to a small portion of the surface of the toner while at the same time exposing the underlying inner portion. By preparing toners in accordance with this process the fusing temperature of the toner is lowered by at least 10° F., thereby resulting in better fixing of the toner and higher quality images when such a toner is used as a developer.

5 Claims, 9 Drawing Figures

ATTRITION PROCESS FOR ALTERATION OF TONER PARTICLES CONTAINING CONDUCTIVE MATERIALS

BACKGROUND OF THE INVENTION

This invention relates to a process for the preparation of electrophotographic developer materials and more specifically to a process for altering the surface of a conductive toner in order to substantially improve the fusing characteristics of such a toner. In one embodiment, magnetic toner materials may be utilized which are applied from a magnetic brush to the electrostatic latent image without the use of a carrier material.

In an electrophotographic process such as a xerographic process, a plate comprising a conductive backing upon which is placed a photoconductive insulating surface can be uniformly charged and thereafter the photoconductor surface exposed to a light image of the original to be reproduced. The photoconductive surface is prepared in such a manner so as to cause it to become conductive under the influence of the light image in order that the electrostatic charge formed thereon can be dissipated selectively to produce what is developed by means of a variety of pigmented resin material specifically made for this purpose such as toners. The toner material used is electrostatically attracted to the latent image areas on the plate in proportion to the charge concentration contained thereon; thus, for areas of high charge concentration there is a correspondingly high toner density. Subsequently, the developed image can be transferred to a final support material such as paper and fixed thereto for a permanent record or copy of the original.

Several methods are known for applying the electroscopic particles to the electrostatic latent image to be developed including for example the development method referred to as cascade development as described in Wise U.S. Pat. No. 2,618,552, a magnetic brush process as described in U.S. Pat. Nos. 2,874,063; 3,251,706; and 3,357,402, a powder cloud development as described in C. F. Carlson's U.S. Pat. No. 2,221,776, and a touchdown development as described in R. W. Gundlach's U.S. Pat. No. 3,166,432.

There has also been suggested systems for developing images and particularly systems for magnetic development wherein a carrier material is not used. For example, in Wilson U.S. Pat. No. 2,846,333 there is disclosed the use of magnetic brush to apply toner particles formed of ferrite and resin material to develop electrostatic latent image. Another process utilizing magnetic toner involves development with a magnetic toner of magnetic images carried on a surface such as a magnetic tape as described in U.S. Pat. No. 3,804,511, one of the disadvantages of such a process being that there is a large amount of magnetite present which results in a toner image which is difficult to fuse particularly at a high rate or at normal fusing temperatures. Additionally, there is described in Kotz U.S. Pat. No. 3,909,258 the development of magnetic images without the use of carriers wherein an electrostatic development process utilizing a magnetic brush without carrier is described. A toner suitable for use in the Kotz process is described in U.S. Pat. No. 3,639,245 to Nelson wherein a dry powder having specific electric conductivity is disclosed. The toner of Nelson is generally formed by melt blending magnetite with the resin and subsequently pulverizing the resulting material to a small particle size and subsequently made conductive by coating the toner with carbon black using heat spheroidization. The resulting toner material is rather conductive due to the layer of surface carbon black and because of this higher fusing temperatures, especially when a toner is prepared in accordance with the process as described in Nelson wherein the toner is fused to zinc oxide paper which paper also is the photoreceptor, are needed in order to obtain substantially complete fusing or if lower fusing temperatures are employed inefficient fusing is obtained. The process of the present invention is particularly useful for treating toners of the Nelson patent, U.S. Pat. No. 3,639,245.

Fixing of the images can be accomplished in a number of techniques including for example, vapor fixing, heat fixing, pressure fixing, or combinations thereof as described for example in U.S. Pat. No. 3,539,161. These techniques of fixing do suffer from some deficiencies which render their use either impractical or difficult for specific electrostatographic applications; thus, for example, it has been found rather difficult to construct an entirely satisfactory heat fuser which has short warm-up time, high efficiency and ease of control. Another problem generally associated with heat fusers is that the burners scorch the support material, for example paper. Similar problems exist with pressure fixing methods whether used with heat or without heat and more particularly the problems involved here include, for example, image offsetting, resolution degradation, and further it cannot consistently produce a good permanent type of fix. The amount of energy needed to cause the fusing is important and generally the higher the amount of energy needed or the higher the temperature is utilized for causing fusing correspondingly the more difficulties are encountered and the lowering of the fusing temperature by several degrees up to 10 degrees has a beneficial effect on the whole system.

Processes and materials which result in lower fusing temperatures when using magnetic toners without carriers are described in copending application U.S. Ser. No. 813,602 filed on July 7, 1977 in the name of Xerox Corporation. Generally in th present invention, the process as described in the copending application is employed but for a more specific purpose, that is for modifying toners containing conductive materials such as surface carbon black, as described in U.S. Pat. No. 3,639,245 in order to lower the fusing temperature.

SUMMARY OF THE INVENTION

It is an object of this invention to provide a process for preparing a toner overcoming the above-noted deficiencies.

It is a further object of this invention to provide a specific process of toner manufacture for altering the surface of conductive toners which are loaded with conductive material.

It is yet another object of the present invention to provide a process which alters the surface of conductive toners loaded with carbon black both on the surface and/or internally.

Still a further object of the present invention is a process for preparing toners which fuse more efficiently and at lower temperatures.

These and other objects of the present invention are accomplished generally by subjecting a toner prepared in almost any manner containing a highly electrically conductive material at the surface to a mild attrition process which removes a small portion of the surface to expose the underlying inner portion. Generally, the toners prepared containing conductive materials such as carbon black at the surface have a high conductivity thereby causing inefficient fusing and the slight attrition obtained with the process of the present invention results in the lowering of the fusing temperature by at least about 10° F.

BRIEF DESCRIPTION OF THE DRAWINGS

FIGS. 1A-4A illustrate the toner of FIGS. 1-4 after treatment.

DESCRIPTION OF THE INVENTION

The present invention relates to a process for the treatment of conductive toners wherein such treatment has the effect of lowering the fusing temperature of the toner particles. The net effect of using the process of the present invention on such conductive toners is to remove some of the surface of the toner particles. The toner particles as prepared by any of several commercial methods some of which are mentioned herein can be treated by the process of this invention. Heavy loading of the carbon particles on the surface of the toner has a "cheese ball" effect which results in a strengthened surface whereby although a polymer of the toner ordinarily would be flowable at certain temperatures the strengthening effect of the solid surface particles results in a higher temperature of fusing necessary in order for the other particles to flow and be adequately fused to the paper surface. It has been theorized that the removal of portions of the surface weakens the structure of the particles thereby allowing flow at lower temperatures. The amount of surface removed in accordance with the present invention is not easily detectable by particle measuring devices. For example, the amount removed is not beyond the normal range of error for a Model T Coulter Counter. The process of this invention generally requires an amount of attrition which results in a lowering of the fusion temperature by greater than 10° F. In this regard, minimum fuse temperature is defined for purposes of this invention as the minimum fuser roll temperature on nip entrance that results in an acceptable fix of toner to paper as measured by the loss of less than 20% of the optical density after 10 cycles on a Model 503 Taber Abraser manufactured by Teledyne Company. The two wheels of the Taber Abraser are CS-10 loaded to 1,000 gm load weight. The CS-10 wheels are cleaned with sandpaper between cycles. A cycle is one revolution of the card passing underneath the abraser wheels.

The effect of the treatment of the toner particles containing conductive materials as described in U.S. Pat. No. 3,639,245 is illustrated by reference to the Figures.

Figure 1:
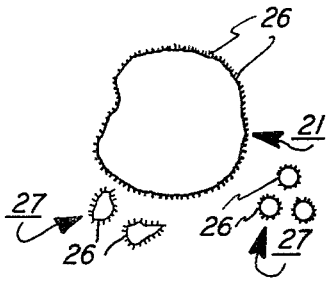
FIGS. 1-4 illustrate untreated toner in cross-section.
Figure 2:
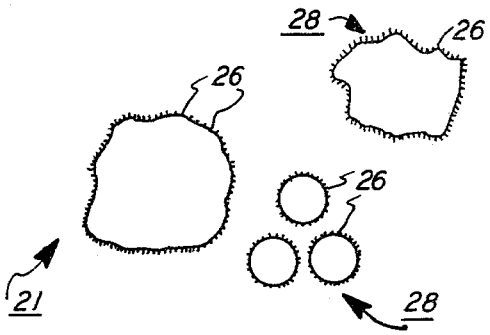
Figure 1A:
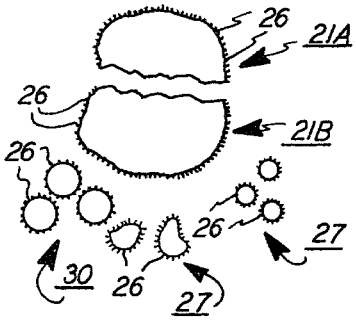
Figure 2A:
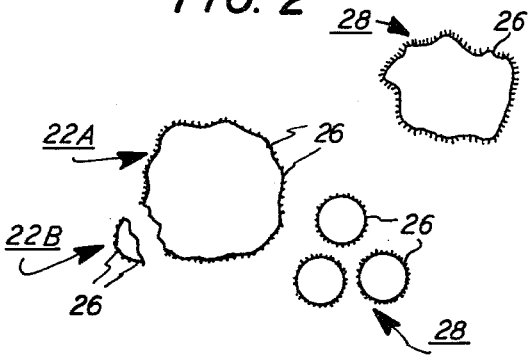
Figure 3:
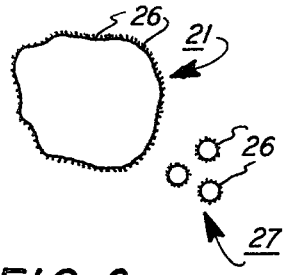
Figure 4:
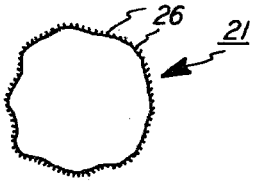
Figure 3A:
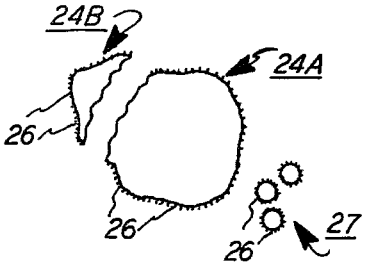
Figure 4A:
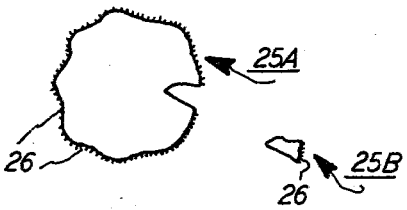

The effect of the treatment of this invention on toner particles is illustrated by reference to FIGS. 1-4 and 1A-4A. In FIGS. 1-4 there is illustrated toner particles 21 prior to treatment. The toner particles as illustrated are generally spherical in shape and contain on their surface carbon black 26. The same particles after treatment by mild attrition are represented by FIGS. 1A-4A. The toner after treatment as illustrated in FIG. 1A now contains split particles 21A and 21B. Similar results are shown by reference to FIG. 2A, particle 22A and the portion attrited 22B, FIG. 3A, particle 24A, and the portion attrited 24B, and FIG. 4A which shows an attrited wedge 25A, and the portion attrited 25B. There are some fines as illustrated by particles 27 although generally the particles are of a fairly uniform size. Some particles 28 remain unchanged after treatment. See for example particles 28 in FIGS. 2 and 2A. As can be seen by the FIGS. 1-4 and 1A-4A the change in the toner particles is minor therefore being rather difficult to detect on particle size measuring devices such as a Model T Coulter Counter. A greater amount of treatment exposes so much of the inner portion as to lead to insulating particles with a smaller size. Particles 30, FIG. 1A illustrates that other particles can also be formed after treatment.

Figure 5:
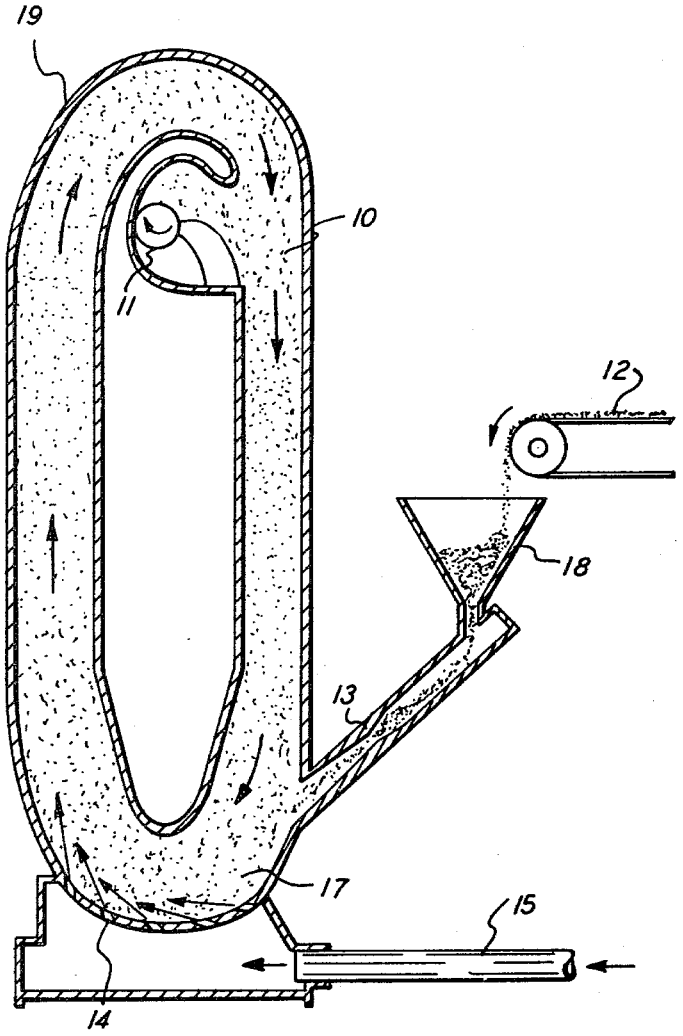
FIG. 5 illustrates a fluid energy mill such as may be utilized in the treatment of toner of the instant invention.

FIG. 5 illustrates a fluid energy mill such as is suitable for the attrition of the invention. In the instant invention the fluid energy mill is operated by insertion of toner material 12 into hopper 18 from which it enters by way of venturi nozzle 13 into the grinding chamber 17 where air which is injected at 15 is induced in the chamber through nozzles 14. The air entering the chamber through nozzles 14 entrains the material in the rapidly circulating turbulent flow where it is pulverized by mutual impaction and attrition. The material proceeds around the mill to the classifier 10 where spent air exits through port 11 taking with it the attrited material which has reached a point that it is light enough to be entrained in the exit stream. Large particles remain entrained and proceed again to the grinding chamber. When a device such as 19 is operated in accordance with the instant invention the feed is fed as fast as possible while the air pressure is set at a very low setting such as about 10 psi to about 150 psi: This flood condition of feed combined with low air pressure gives very little turbulence and a very small amount of grinding and attrition takes place. Low air pressure reduced velocity and centrifugal force on particles which results in quick exit through port 11. Quick exit results in a low amount of attrition.

Any type of attrition device may be utilized in the instant invention that results in lowered minimum fuse temperature without harmful effect to other properties. Generally fluid energy mills such as micronizers are suitable. The preferred method is jetting of the toner at low pressure and high feed rate thus allowing a large quantity of material to be processed at low cost.

Any suitable resin material may be used for the toner compositions of the present invention. Substantially transparent resins are preferred when the toner is to be used in a color electrophotographic system. Although any substantially transparent resin material may be utilized as the resin component of this toner, it is preferable that resins having other desirable properties be utilized in this invention. Thus, for example, it is desirable that a resin be used which is a non-tacky solid at room temperature so as to facilitate handling and use in the most common electrophotographic processes. Thermolplastics are desirable with softening points significantly above room temperature, but below that of which ordinary paper tends to char so that once the toner images form thereon or transfer to a paper copy sheet it may be fused in place by subjecting it to heat. The resins selected should desirably have good triboelectric properties and have sufficient insulating properties to hold charge so that they may be employed in a number of development systems.

While any suitable resin possessing the properties as above described may be employed in the system of the present invention, particularly good results are obtained with the use of vinyl resins and polymeric esterification products of a dicarboxylic acid and a diol comprising diphenol. Any suitable vinyl resin may be employed in the toners of the present system including homopolymers or copolymers of two or more vinyl monomers. Typical of such vinyl monomeric units include: styrene; p-chlorostyrene; vinyl naphthalene; ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof.

It is generally found that toner resins containing a relatively high percentage of styrene are preferred since greater image definition and density are obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric stability and uniform resistance against physical degradation. However, non-vinyl thermoplastic resins may also be employed including resin modified phenol formaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the present invention. The diphenol reactant has the general formula:

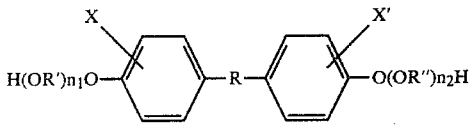

wherein R can be substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' are substituted and unsubstituted alkylene radicals having from 2 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R is an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxy-ethoxy-phenyl)-butane, 1,1-bis(4-hydroxy isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl) norbornane, 2,2-bis(4-beta hydroxy styryl oxyphenyl) propane, the polyoxyethyelen ether of isopropylidene diphenol in which both phenolic hydroxy groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol disclosed herein to form the toner compositions of this invention either substituted or unsubstituted, saturated or unsaturated, having the general formula:

$$HOOCR'''_{n_3}COOH$$

wherein R''' is a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperature is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Any suitable pigment or dye may be employed as the colorant for the toner particles. Toner colorants are well known and include, for example, carbon black, nigrosine dye, aniline blue, Calco Oil Blue, chrome yellow, ultramarine blue, Cu Pont Oil Red, Quinoline Yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of typed documents are desired, the toner may comprise a black pigment such as carbon black or a black dye such as Amaplast Black dye, available from the National Aniline Products, Inc. Preferably, the pigment is employed in an amount from about 3 percent to about 20 percent by weight, based on the total weight of the colored toner. If the toner colorant employed is a dye, substantially smaller quantities of colorants may be used.

The toner compositions of the present invention may be prepared by any well known mixing and combination technique. For example, the ingredients may be thoroughly melt mixed by blending, mixing and milling the components and thereafter micropulverizing the resulting mixtures. Another well known technique for forming toner particles is to spray-dry a ball-milled toner composition comprising a colorant, a resin and a solvent.

Optimum xerographic results and better images are achieved with styrene-n-butyl methacrylate copolymers, styrene vinyl acrylate copolymers, styrene acrylate copolymers, polystyrene resins, predominately polystyrene of polystyrene based resin as generally described in U.S. Pat. No. Re. 25,136 to Carlson and polystyrene blends as described in U.S. Pat. No. 2,788,288 to Rheinfrank and Jones.

Any method for forming the toner particles may be utilized in the practice of the present invention as long as that method results in a toner of desired properties, that is having lower fusing temperature. Some typical conventional methods of forming toner are disclosed in U.S. Pat. No. 3,639,245 include hot melt formation and mastication followed by attrition to toner particle size and heat spheroidization to coat with carbon black. This invention is particularly useful for lowering the fusing temperature and generally allowing fusing for the toners containing conductive carbon on the surface and using zinc oxide paper as the copy medium in one embodiment as described in U.S. Pat. No. 3,639,245 fully incorporated herein by reference.

The following examples further define, describe and compare methods of preparing toners of the present invention and of utilizing them in electrophotographic applications. Parts and percentages are by weight unless otherwise indicated.

DESCRIPTION OF THE PREFERRED EMBODIMENTS

Example I

There was fed into a Banbury mill for mixing for about 5 minutes a mixture comprised of 40 parts of 65/35 styrenebutyl methacrylate copolymer resin, 50 parts of magnetite (K-378 submicron particle size magnetite commercially available from Northern Pigments, Toronto, Canada) and 10 parts of Vulcan (a carbon black commercially available from Cabot Corporation). The resulting mixture was then placed in a rubber mill for about 5 minutes to further disperse the carbon black and magnetite within the resin matrix and obtain better uniformity. After treatment in the rubber mill there was obtained a uniform dispersed composition of carbon black and magnetite in the resin matrix. This composition was then rough crushed in a hammer mill and finely subdivided in a fluid energy mill pulverizer resulting in a toner powder composition having an average particle size of 15 microns and a range of from about 5 to about 30 microns as measured by a Coulter Counter.

The resulting powder material is then dry blended with an appropriate quantity, about 5% by weight of conductive carbon black and after thorough mixing the carbon black was embedded into the resin by a spheroidization process as described in U.S. Pat. No. 3,639,245.

The amount of conductive carbon black used can range from about 0.1 to 15% with a preferred range being 1% to 10% by weight.

This material is then subjected to mild attrition, which causes chipping, resulting in the removal of a small portion of its surface thus exposing the underlying inner portion. The chipping is accomplished by feeding the material produced by spheriodization into a model 0202 Jet-O-Mizer manufactured by Fluid Energy Incorporated, Hatfield, Penna., at flood feed condition of about 180 lbs. per hour and a pressure of about 50 psi. The comparison of particles size utilizing a Coulter Counter Model T did not indicate any measurable difference in particle size after treatment. The toner however had a reduction of about 25° F. in the minimum fuse temperature when compared with the toner prior to fluid energy mill treatment. The device utilized to test the fuser latitude consisted of a conformable silicone rubber coated fuser roll lubricated with silicone oil and internally heated when this material is used in an electrophotographic imaging system images of high quality and excellent fix were observed.

Example II

The composition as described in U.S. Pat. No. 3,639,245 is prepared following the procedure of Example I which involves blending on a conventional heated roll rubber mill 4 parts of Epon 1004 (a product available from Shell Chemical Company) with 6 parts of magnetite. The resulting powder material was pulverized in an attrition type grinder and classified in a standard air-centrifugal type apparatus, and particles having diameters of 1 to about 15 microns are obtained.

These particles are then spheriodized by feeding the above powder into an air aspirator at about 800 grams per hour. The aspirator treatment results in the formation of an aerosol which is directed into a heated air stream, the temperature of which is about 900° to 1000° F. The powder was allowed to settle and collected. This powder is then mixed with 1.50% by weight of conductive carbon black, causing the carbon black to become embedded into the resin by the spheriodization process as described above with the exception that the temperature of the air stream is about 740° F.

This material is subjected to mild attrition, which causes "chipping," resulting in the removal of a small portion of its surface thus exposing the underlying inner portion. The "chipping" is accomplished by feeding the material produced by spheriodization into a model 0202 Jet-O-Mizer manufactured by Fluid Energy Incorporated, Hatfiedl, Penna., at flood feed condition of about 180 lbs. per hour and a pressure of about 50 psi. The comparison of particles size utilizing a Coulter Counter Model T did not indicate any measurable difference in particle size after treatment. The toner however had a reduction of about 25° F. in the minimum fuse temperature when compared with the toner prior to fluid energy mill treatment. The device utilized to test the fuser latitude consisted of a conformable silicone rubber coated fuser roll lubricated with silicone oil and internally heated when this material is used in an electrophotographic imaging system images of high quality and excellent fix were observed.

Example III

The process of Example I is repeated with the exception that 100 parts of 65/35 styrene-butylmethacrylate resin is dissolved in about 800 parts of toluene and subsequently there is added 100 parts magnetite (submicron particle size magnetite commercially available from Northern Pigments, Toronto, Canada K-378). The slurry is milled for 30 minutes in a dispersion mill and then spray-dryed in a 30-inch Bowen Spray Dryer at the following process conditions—inlet temperature 180° F., slurry feed rate 200 milliliters per minute. The product is then put into a secondary drying device to substantially eliminate the residual toluene. This results in toner particles generally uniform in size and spherical in shape.

Conductive carbon black is embedded into the resin as accomplished in Example I and the resulting material is subjected to attrition in accordance with Example I. Substantially similar results are observed, that is a reduction of about 20° F. in the minimum fuse temperature.

Example IV

The process of Example I is repeated except the fluid energy mill pressure is set at about 30 psi. This results in a toner decrease in minimum fuse temperature of about 10° F. when compared with untreated toner.

Example V

The procedure of Example III is repeated with the exception that chloroform is used instead of toluene. Substantially similar results are obtained.

Other modifications of the present invention will occur to those skilled in the art upon a reading of the present disclosure. These are intended to be included within the scope of this invention.

What is claimed is:

1. A process for lowering the minimum fuse temperature of a toner material containing a resin and a conductive coating by subjecting the toner material to a minor amount of attrition, thereby causing the removal of small amounts of the toner conductive coating material, thus exposing the inner portions of the toner particles and rendering such particles less conductive whereby the altered particles have a minimum fuse temperature greater than 10° F. below the fuse temperature of unaltered particles.

2. A process in accordance with claim 1 wherein the small portion of surface removed corresponds to the action of a fluid energy mill operating at between about 10 and about 150 psi under substantially flood feed condition.

3. A process in accordance with claim 1 wherein said attriting is not detectable as a change in average particle size by Coulter Counter Measurement.

4. A process in accordance with claim 1 wherein the coating is conductive carbon embedded in the toner particles.

5. A process in accordance with claim 1 wherein the toner material has added thereto magnetite.

* * * * *